US007699300B2

(12) United States Patent
Iguchi

(10) Patent No.: US 7,699,300 B2
(45) Date of Patent: Apr. 20, 2010

(54) SHEET POST-PROCESSING APPARATUS

(75) Inventor: Ken Iguchi, Sunto-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 560 days.

(21) Appl. No.: 11/670,070

(22) Filed: Feb. 1, 2007

(65) Prior Publication Data

US 2008/0185763 A1 Aug. 7, 2008

(51) Int. Cl.
*B65H 37/04* (2006.01)

(52) U.S. Cl. ..... 270/45; 270/32; 270/37; 270/51; 270/58.07; 270/58.08; 270/58.09; 493/416; 493/424; 493/435; 493/442; 493/445; 493/454

(58) Field of Classification Search ..... 270/32, 270/37, 45, 51, 58.07, 58.08, 58.09; 493/416, 493/424, 434, 435, 442, 445, 454
See application file for complete search history.

(56) References Cited

U.S. PATENT DOCUMENTS 6,003,853 A * 12/1999 Nakazawa et al. ..... 270/58.11
2004/0104525 A1* 6/2004 Suzuki et al. ..... 270/32

FOREIGN PATENT DOCUMENTS

JP 2003-079189 3/2003
JP 2004189421 A * 7/2004
JP 2005-008418 1/2005
JP 2005-287187 10/2005
JP 2007076832 A * 3/2007

* cited by examiner

*Primary Examiner*—Gene Crawford
*Assistant Examiner*—Leslie A Nicholson, III
(74) *Attorney, Agent, or Firm*—Turocy & Watson, LLP

(57) ABSTRACT

In a sheet post-processing apparatus that folds a sheet bundle, a folding roller drive motor that drives folding rollers is PWM driven such that its speed is varied in each control during the period until a blade contacts the sheet bundle, during the period when the sheet bundle is conveyed to a discharge port, during discharge operation, and during return of the motor to its home position.

7 Claims, 6 Drawing Sheets

| SHEET SIZE | PERCENTAGE |
|---|---|
| A4 | 1.0 |
| A3 | 0.9 |
| B5 | 1.1 |

| NUMBER OF SHEETS TO BE PROCESSED | PERCENTAGE |
|---|---|
| 5 OR LESS | 1.0 |
| 6 TO 10 | 0.9 |
| 11 OR MORE | 0.8 |

Fig. 8

SHEET POST-PROCESSING APPARATUS

BACKGROUND OF THE INVENTION

1. Field of the Invention

The present invention relates to a sheet post-processing apparatus disposed with saddle stitching and folding functions, and in particular to a sheet post-processing apparatus that can realize high-precision folding.

2. Description of the Related Art

Sheet post-processing apparatus disposed with a bookbinding function that binds, with staples, plural sheets on which images have been formed are being developed. As binding methods performed by such sheet post-processing apparatus, there are end stitching, which binds one place or plural places on an edge portion of a sheet bundle, and saddle stitching, which binds plural places in the center portion of a sheet bundle. Among apparatus that perform saddle stitching, there are apparatus disposed with a saddle stitching and folding function that folds the center portion of a bound sheet bundle to form a weekly.

In the saddle stitching and folding function that folds the center portion of a bound sheet bundle to form a weekly, the means for folding the center portion is configured by a blade and a pair of folding rollers. (e.g., JP-A-2005-8418)

In this configuration the means for folding the center portion of the sheet bundle pushes the center portion of the conveyed sheet bundle with the blade into the portion where the pair of folding rollers face each other and folds the sheet bundle with pressure resulting from the rotation of the folding rollers.

The sheet bundle that has been folded is discharged from the folding rollers, conveyed along a conveyance path, and accumulated in a saddle tray.

Because it is necessary for the folding rollers to precisely fold the sheet bundle, it is necessary for the folding rollers to sufficiently impart a predetermined weight with respect to the fold portion of the sheet bundle. For that reason, low-speed rotation is imparted to the folding rollers.

Ordinarily, the folding rollers rotate at a uniform speed, so the folding rollers convey the sheet bundle at the same low-speed rotation as the number of rotations with respect to the fold portion of the sheet bundle with respect also to conveying the sheet bundle after the fold portion of the sheet bundle has been processed. For that reason, the total amount of processing time required to fold the sheet bundle and thereafter convey the sheet bundle requires a lot of time.

BRIEF SUMMARY OF THE INVENTION

It is an object of the present invention to provide a sheet post-processing apparatus disposed with a folding roller drive motor that drives a pair of folding rollers for center-folding a sheet bundle.

In an aspect of the present invention, a sheet post-processing apparatus includes, stitching means for stitching with staples a sheet bundle conveyed along a conveyance path, the stitching means stitching the sheet bundle at plural places thereof along a straight line orthogonal to the conveyance direction; folding means including a pair of folding rollers disposed downstream of the stitching means on the conveyance path and a blade that pushes the sheet bundle into a contact portion of the pair of folding rollers; a folding roller drive motor that drives the pair of folding rollers; and control means for controlling the driving or stopping operation of the folding roller drive motor in correspondence to the process of folding the sheet bundle, wherein the control means varies the speed of the folding roller drive motor during the period until the blade contacts the sheet bundle, during the period when the sheet bundle after folding is conveyed to a discharge port, during discharge operation of the sheet bundle, and during return of the folding roller drive motor to a home position.

DESCRIPTION OF THE DRAWINGS

FIG. 8 is a chart showing control examples corresponding to types of sheets and numbers of sheets to be processed.

DETAILED DESCRIPTION OF THE INVENTION

Throughout this description, the embodiments and examples shown should be considered as exemplars, rather than limitations on the apparatus and methods of the present invention.

The best mode for implementing the present invention will be described in detail below with reference to the drawings.

Figure 1:
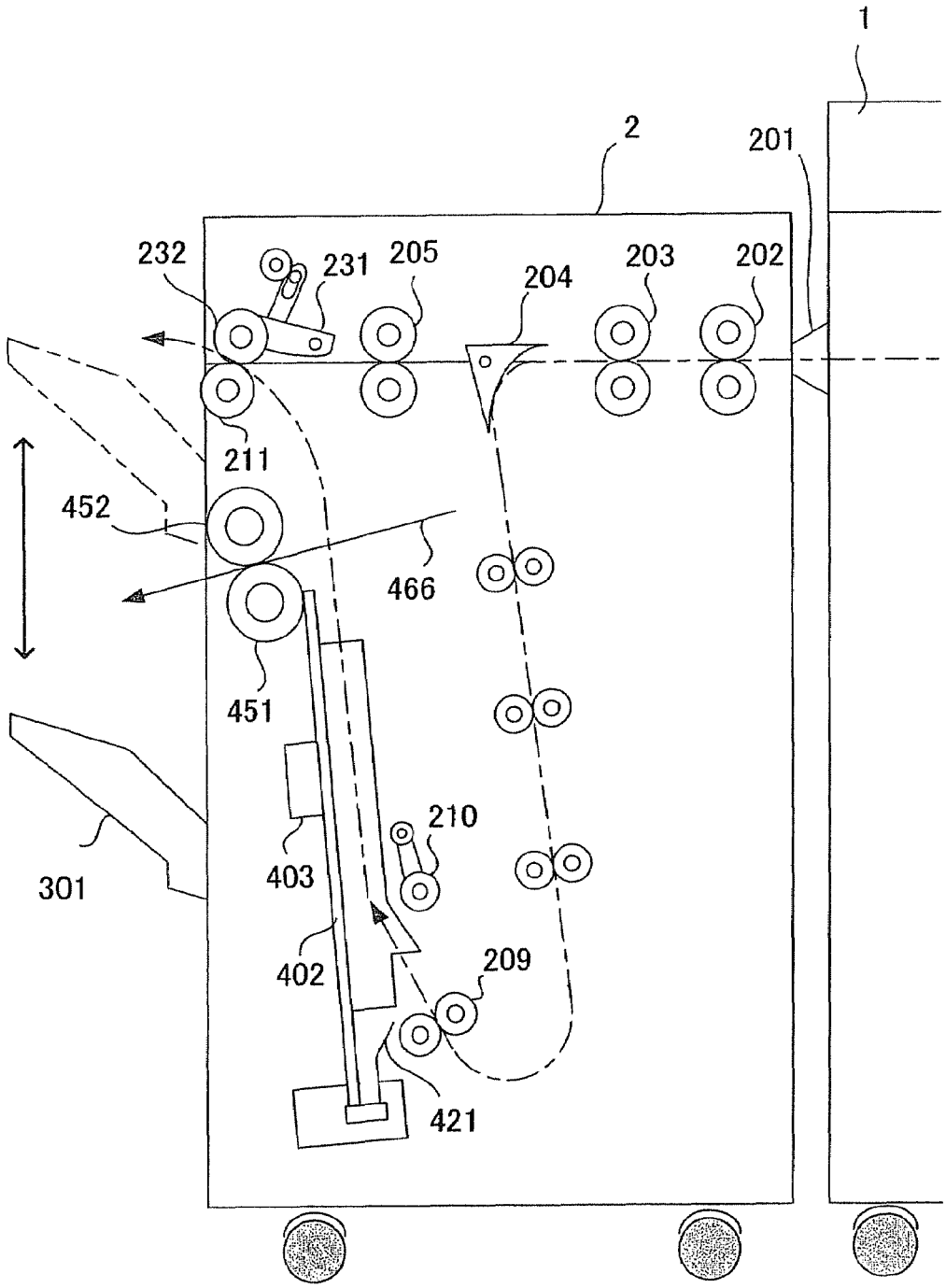
FIG. 1 is a schematic cross-sectional view of a sheet post-processing apparatus that is an embodiment of the present invention.

FIG. 1 is a schematic cross-sectional view of a sheet post-processing apparatus 2 that is the best embodiment for implementing the present invention. This sheet post-processing apparatus 2 includes a simple bookbinding function that receives sheets on which images have been formed by an image forming apparatus 1, staples the sheets, and folds a sheet bundle SP that has been stapled.

As shown in FIG. 1, the sheet post-processing apparatus 2 is configured as a result of an inlet guide plate 201, feed rollers 202 and 203, a bifurcation pawl 204, a discharge-use feed roller 205, a staple tray 402, a staple tray feed roller 209, a paddle 210, a sheet trailing end receiver 421, saddle stitching staplers 403, conveyance rollers 211 and 232, a paper discharge guide plate 231, a blade (staple abutting member) 466, folding rollers 451 and 452, and a paper discharge tray 301 being disposed along a conveyance path on which the sheet bundle SP is conveyed.

First, the schematics of operation in the sheet post-processing apparatus 2 after receiving sheets from the image forming apparatus 1 will be described. Sheets discharged from the image forming apparatus 1 are guided by the inlet guide plate 201 to the conveyance path inside the apparatus, and the sheets are conveyed by the feed rollers 202 and 203 and sent by the bifurcation pawl 204 to either a conveyance path for discharge or a conveyance path for stapling.

When the conveyance path for stapling has been selected, the sheets are fed by the staple tray feed roller 209 to the staple tray 402, and here, the sheets are dropped one sheet at a time by the paddle 210 toward the lower portion of the stable tray 402. The sheets dropped by the paddle 210 are received by the sheet trailing end receiver 421 and the sheet trailing ends are aligned. Alignment in the width direction (direction orthogonal to the sheet conveyance direction) of the sheets is performed by an unillustrated transverse aligning plate. At this time, in a state where saddle stitching of stapling modes has been selected, the conveyance roller 232 is in a position separated from the conveyance roller 211 by rotation of the paper discharge guide plate 231.

Further, in the case of saddle stitching operation, after the last sheet has been aligned, saddle stitching is performed at two places with respect to the sheet bundle SP by two saddle stitching staplers 403 disposed a predetermined distance apart from each other in the horizontal direction. The binding positions are on a line in the center of the sheets in an orientation that is the same as the sheet conveyance direction.

Then, the sheet bundle SP is lifted upward by an unillustrated bundle feeding belt and stopped when the position of the staples bound by the saddle stitching staplers 403 reaches a predetermined position.

Figure 2:
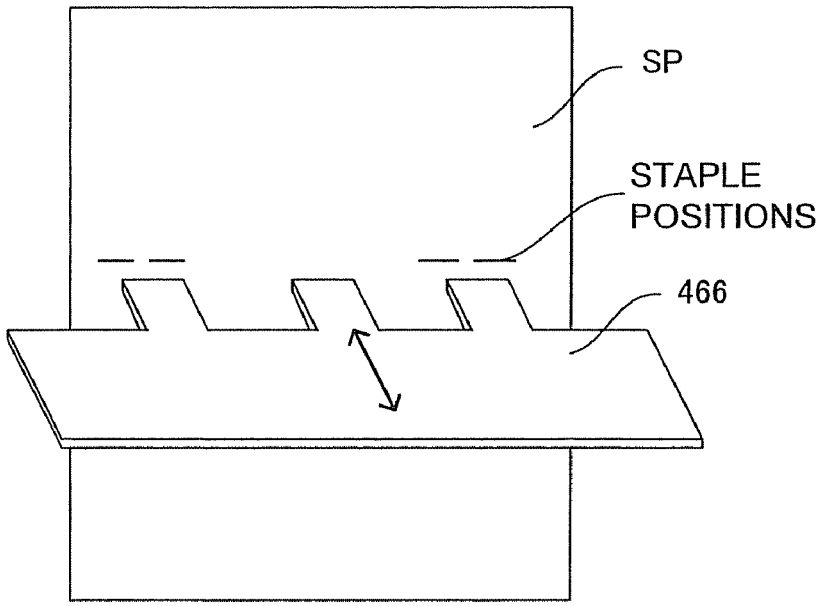
FIG. 2 is a perspective view showing the positional relationship between a sheet bundle and a blade when the sheet bundle is stopped at a predetermined position in the sheet post-processing apparatus of the present invention.

FIG. 2 is a perspective view showing the positional relationship between the sheet bundle SP and the blade 466 at this time. In conveyance operation by the bundle feeding belt, as shown in the same drawing, the blade 466 waits in a position away from the sheet bundle SP.

Figure 3:
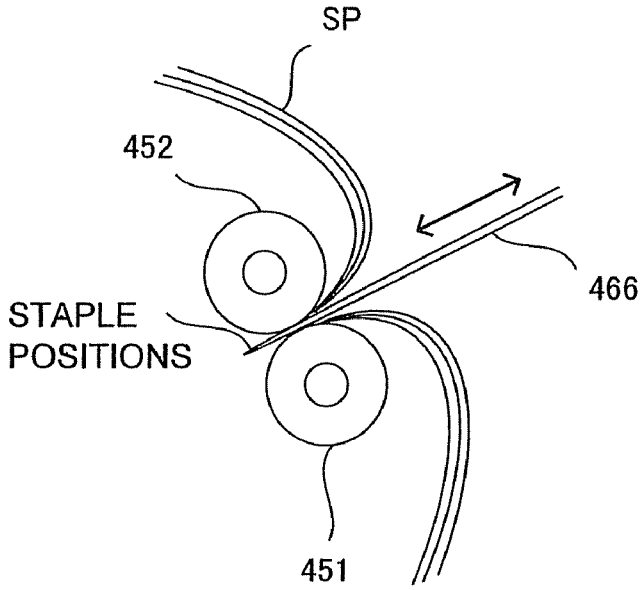
FIG. 3 is a side view when folding the sheet bundle in the sheet post-processing apparatus of the present invention.

Thereafter, later-described operation in the vicinities of the conveyance rollers 211 and 232 and by the blade 466 is performed with respect to the sheet bundle SP, and as shown in FIG. 3, the center portion of the sheet bundle SP is pushed between the folding rollers 451 and 452 by the blade 466. After simple bookbinding has been performed in this manner, the sheet bundle SP is discharged into the paper discharge tray 301.

On the other hand, when the conveyance path for discharge has been selected as the conveyance destination of the sheets received from the image forming apparatus 1, the sheets are sent by the bifurcation pawl 204 to the discharge-use feed roller 205, fed by the conveyance force of the discharge-use feed roller 205 to the conveyance rollers 211 and 232, and discharged as they are into the paper discharge tray 301. It will be noted that operation of each part in the sheet post-processing apparatus 2 is controlled by unillustrated control means (a CPU) on the basis of instruction input from a user.

Figure 4:
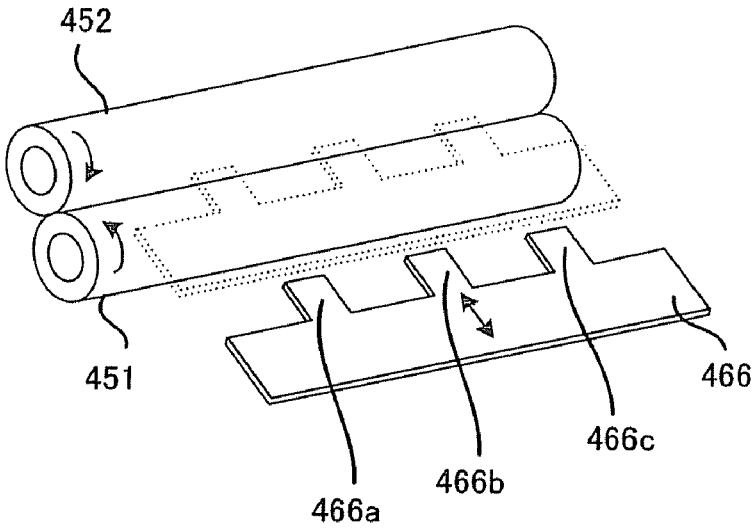
FIG. 4 is a perspective view showing the positional relationship between the blade and folding rollers for folding in the sheet post-processing apparatus of the present invention.
Figure 5:
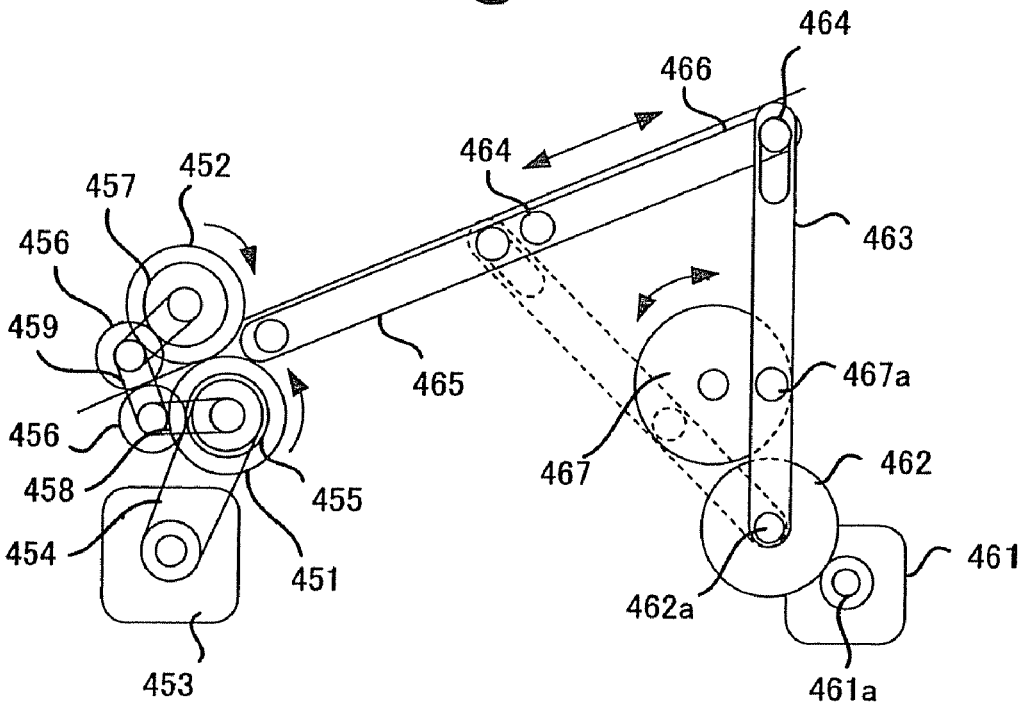
FIG. 5 is a side view of a mechanism for driving the blade in the sheet post-processing apparatus of the present invention.

Next, the configuration of a folding unit will be described. FIG. 4 is a perspective view of the blade 466 and the folding rollers 451 and 452 for folding, and FIG. 5 is a side view of a mechanism for driving the blade 466. The thin plate-like blade 466 includes shaft portions 464 that are integrated with its undersurface and fitted inside a guide groove (guide slit) 465 such that the blade 466 is movable in the direction of the arrows along the inside of the guide groove 465, and rotational drive from an output gear 461*a* of a blade drive motor 461 is transmitted to a cam 467 via an intermediate gear 462 so that the cam forwardly and reversely rotates. One end of a link 463 is supported, such that it may freely rotate, by a shaft portion 462*a* of the intermediate gear 462, and one of the shaft portions 464 freely fits inside an elongate hole disposed in the other end of the link 463. A pin 467*a* disposed on the cam 467 is supported in the intermediate portion of the link 463, and the link 463 swings between the solid line position and the dotted line position by the forward and reverse rotation of the cam 467, whereby the blade 466 reciprocally moves in a straight line in the direction of the arrows.

Further, convex portions 466*a*, 466*b*, and 466*c* are disposed on the distal end portion of the blade 466, and the convex portions 466*a* and 466*c* are disposed in the same positions as the staple positions of the saddle stitching staplers 403. The convex portion 466*b* is disposed in the center of the two staple positions of the saddle stitching staplers 403. The reason that the three convex portions 466*a*, 466*b*, and 466*c* are disposed is because, when there are two convex portions on the blade 466, the center portion of the sheet bundle SP is not completely pushed and bends when the sheet bundle SP is pushed into the folding rollers 451 and 452, such that wrinkles occur in the center portion in the folded state, so the three convex portions 466*a*, 466*b*, and 466*c* handle this.

The folding rollers 451 and 452 have a configuration where they are driven to rotate from both sides by the driving of a drive gear pulley 455, intermediate gears 456, and a driven gear 457 via a timing belt 454 by the driving of a folding roller drive motor 453. The drive gear pulley 455, the intermediate gears 456, and the driven gear 457 are coupled together by arms 458 and 459 and configured such that their mutually relative positions are movable while their inter-axial distances are maintained. Thus, even in a state where the sheet bundle SP is nipped between the folding rollers 451 and 452 and the rollers are apart, rotational drive can be reliably transmitted to both of the folding rollers 451 and 452. Further, the folding rollers 451 and 452 are pressed into contact with each other by tension springs (not shown).

The convex portions 466*a*, 466*b*, and 466*c* on the blade 466 distal end push the staple positions stapled in the sheet bundle SP, move forward to a position overlapping the nip position of the folding rollers 451 and 452, and fold the center portion of the sheet bundle SP by the pressure contact and rotation of the folding rollers 451 and 452.

A publicly known brushless DC motor can be used for the folding roller drive motor 453. The used brushless DC motor uses an encoder to detect the rotational angle of a permanent magnet type rotor, switches the excitation current (armature current) supplied to an armature winding of a stator, and forms a rotational magnetic field in the stator to cause the rotor to rotate.

The control uses a voltage type PWM inverter (control means) that PWM (Pulse Width Modulation) controls the excitation current of the armature winding with a duty (ON time/(ON time+OFF time)) corresponding to a torque command representing a target output.

In this voltage type PWM inverter, plural switching elements (e.g., power MOSFETs) that form a bridge circuit are controlled ON and OFF by a bootstrap type drive circuit (gate circuit). Further, the bootstrap type drive circuit is disposed with a bootstrap condenser for supplying a drive current (gate current) charged by a predetermined voltage and sends the drive current (gate current) from this condenser to control ends (gates) of the switching elements when a PWM control signal of the duty corresponding to the torque command is ON to switch ON the switching elements, and applies the drive current in the opposite direction when the PWM control signal is OFF to switch OFF the switching elements.

Next, control of the folding roller drive motor 453 that drives the folding rollers with respect to the series of processing during folding will be described.

Figure 6:
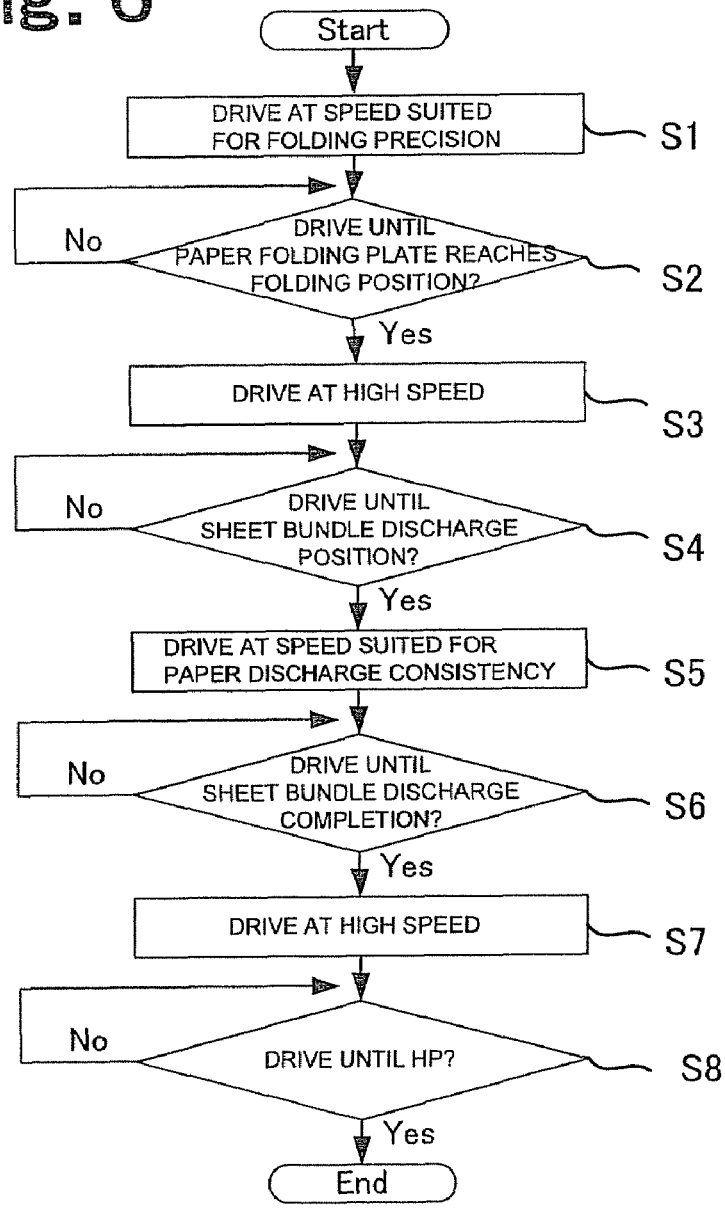
FIG. 6 is a flowchart of control of a folding roller drive motor in the sheet post-processing apparatus of the present invention.
Figure 7:
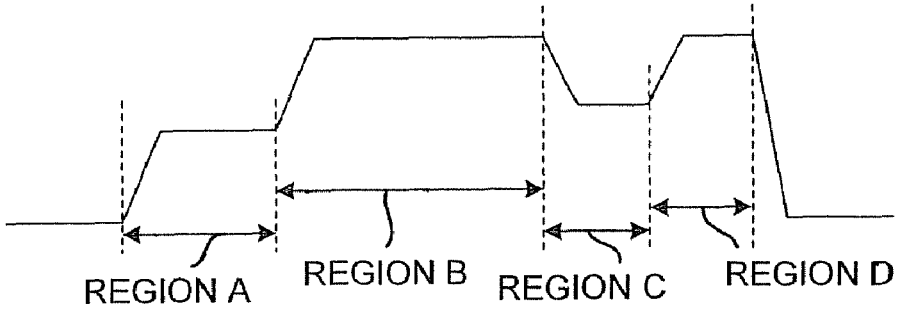
FIG. 7 is a timing chart of the folding roller drive motor in the sheet post-processing apparatus of the present invention.

FIG. 6 is a flowchart of control resulting from PWM driving of the folding roller drive motor 453, and FIG. 7 shows a timing when the folding roller drive motor 453 is PWM driven to change the duty and cause the rotational speed to change.

Because the folding rollers 451 and 452 are driven by the folding roller drive motor 453, their rotation is controlled in accordance with the PWM driving of the folding roller drive motor 453.

When folding begins, the folding roller drive motor 453 starts driving and waits for the sheet bundle SP to be conveyed, and in this state, it is driven at a speed (region A shown in FIG. 7) suited for predetermined folding precision (step S1).

The sheet bundle SP is conveyed to the position of the folding rollers 451 and 452, the blade 466 is driven to the folding position of the sheet bundle SP, and the blade 466 is driven at a speed suited for predetermined folding precision until it contacts the sheet bundle SP (step S2). When it has not been driven to the folding position, it is driven until it reaches the folding position.

When it has been determined that the blade 466 has been driven to the folding position of the sheet bundle SP, the contacting blade 466 moves further forward and pushes the sheet bundle SP into the folding rollers 451 and 452. Thus, the folding rollers 451 and 452 nip and press a folding target site that is the head position of the sheet bundle SP and fold the sheet bundle SP with the rotation of the folding rollers 451 and 452.

When folding with respect to the folding target site ends, the folding roller drive motor 453 is driven at a speed (region B shown in FIG. 7) that is higher than the above-described speed suited for folding precision (step S3). The folding approximates line contact between the sheet bundle and the folding rollers 451 and 452, and the amount of time in which the pressure of folding acts on the sheet bundle SP is not that long. Consequently, immediately after folding ends, the sheet bundle SP needs only be conveyed to a discharge port, so the performance of the entire sheet post-processing apparatus improves more when the sheet bundle SP is conveyed at a high speed. During this high speed driving, the folding rollers 451 and 452 convey the non-folding target site of the sheet bundle SP.

The passage of the trailing end of the sheet bundle SP is detected by a discharge position sensor (not shown) whereby this high speed driving is maintained until the sheet bundle SP is conveyed to a discharge position (step S4).

When it is detected that the folded sheet bundle SP has reached the discharge position, the folding roller drive motor 453 is driven by a speed suited for maintaining paper discharge consistency (region C shown in FIG. 7) and discharges the sheet bundle SP (step S5). The speed suited for maintaining paper discharge consistency is an intermediate speed, so to speak, and is such that the alignment of the folded sheet bundle SP is not disturbed.

The passage of the trailing end of the sheet bundle SP is detected by a discharge confirmation sensor (not shown), whereby the folding roller drive motor 453 is driven at an intermediate speed until the completion of discharge of the sheet bundle SP (step S6).

When it has been determined that discharge of the sheet bundle SP has been completed, then the folding roller drive motor 453 is driven at a high speed (region D shown in FIG. 7) (step S7). The folding roller drive motor 453 is substantially without load, so the performance of the entire sheet post-processing apparatus improves more when the folding roller drive motor 453 returns to its home position in a short period of time.

It is determined whether or not the folding roller drive motor 453 has been driven to its home position by an output signal from the encoder (not shown) disposed in the folding roller drive motor 453 (step S8). When the folding roller drive motor 453 has been driven to its home position by the output signal from the encoder, then control ends. It will be noted that when the folding roller drive motor 453 has not been driven to its home position by the output signal from the encoder, then the folding roller drive motor 453 is driven to its home position, and thereafter control ends.

In each of the above steps, it is preferable for the ratio of each drive speed of the folding roller drive motor 453 shown in FIG. 7 to be set such that, for example, region A:region B:region C:region D=60; 100; 80:100.

These drive speed percentages describe a case where the type of sheet is the same and the number of sheets to be processed is the same. However, the percentages are not limited to these and can be varied in accordance with the type of sheet and the number of sheets to be folded. In regard to the type of sheet, the sheets may be distinguished by sheet size or by sheet thickness.

For example, when distinguished by sheet size, the percentages can be set as shown in FIG. 8. FIG. 8 shows an example of control where, when the sheet size is A3, all of the drive speeds are changed to speeds of 0.9 times following the percentage in the table shown in FIG. 8. Further, control that changes or does not change the percentages by sheet size can be set beforehand, so that even with A3 sheets, control that does not change the percentages can be done in regard to the amount of time in which a sheet bundle after being folded is conveyed to the discharge port.

Moreover, control corresponding to the number of sheets to be folded and the thickness of the sheets can also be performed in the same manner.

It will be noted that, in the above folding operation, the folding rollers 451 and 452 cannot directly pressure-contact the portion of the sheet bundle SP nipped by the convex portions 466*a*, 466*b*, and 466*c* of the blade 466 and by the folding rollers 451 and 452, so the folded state becomes bad in correspondence to the thickness of the blade 466. In regard to the folded state of the staple positions, folding becomes bad due to the thickness of the staples in comparison to places where there are no staples, so given that the convex portions 466*a* and 466*c* on the blade 466 coincide with the staple positions in the sheet bundle SP, positions where the folded state becomes bad coincide with the staple positions so that a state of minimum folding can be ensured.

Further, in operation where the convex portions 466*a*, 466*b* and 466*c* on the blade 466 push the sheet bundle SP, move forward to the position overlapping the nip position of the folding rollers 451 and 452, and fold the center portion of the sheet bundle SP by the pressure-contact and rotation of the folding rollers 451 and 452, it is necessary for the convex portions 466*a*, 466*b*, and 466*c* on the blade 466 that has moved forward to retreat from the pressurized state of the sheet bundle SP and the folding rollers 451 and 452, but at this time, the portions where the blade 466 is nipped in the folding rollers 451 and 452 are just the convex portions 466*a*, 466*b*, and 466*c*, and the area is small, so the frictional force of the folding rollers 451 and 452 is small and the load of the drive unit when retreating is small.

Additionally, after the drive motor of the conveyance rollers 232 and 211 stops, the rotation of the drive motor is locked so that the sheet bundle SP leading end portion is fixed. By locking the conveyance rollers 232 and 211, the fixing of the sheet bundle SP by the paper discharge guide plate 231 can be made reliable.

Figure 9:
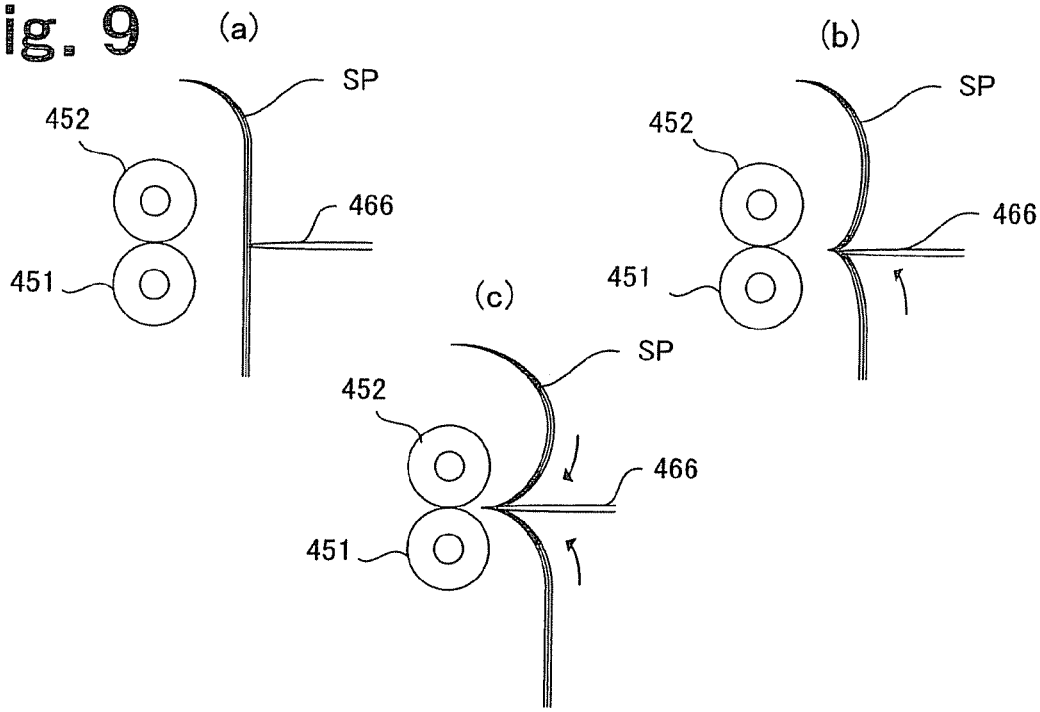
FIG. 9(*a*) to (*c*) are side views showing a pushing position of the blade and the movement of the sheet bundle during folding in the sheet post-processing apparatus of the present invention.

Next, as shown in FIGS. 9(*a*) and (*b*), the sheet portion directly on the binding staples is pushed by the blade 466, the blade leading end portion catches the staples in the fixed sheet bundle SP, receives resistance resulting from friction, and pushes the sheet bundle SP in the direction of the nip portion of the folding rollers 451 and 452 as shown in FIG. 9(*c*).

Figure 10:
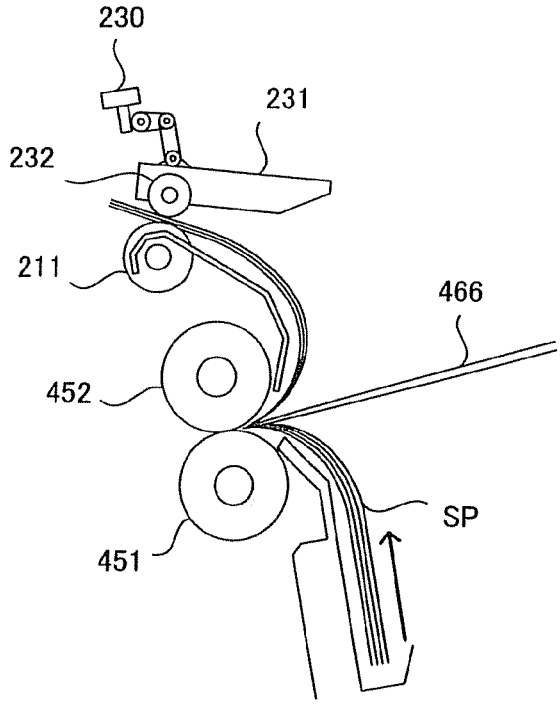
FIG. 10 is a side view showing a state when the sheet bundle is folded while being fixed by a paper discharge guide plate in the sheet post-processing apparatus of the present invention.

As shown in FIG. 10, the sheet bundle SP leading end portion is fixed using the paper discharge guide plate 231, whereby movement of the sheet bundle SP resulting from bending occurring as a result of the blade 466 pushing is just from the direction of the trailing end of the sheet bundle SP that is not fixed, and the folding positions are stable. As a result, because the sheet bundle SP is pushed in a state where the binding staples always strike the distal end of the blade 466, folding where the staple positions and the folding positions of the sheet bundle SP reliably coincide can be performed. Additionally, after the sheet center portion has been folded by the folding rollers 451 and 452, the sheet bundle SP is discharged as is into the paper discharge tray 301 from the nip portion of the folding rollers 451 and 452.

According to the above-described embodiment, folding precision and paper discharge consistency after folding can be improved without dependence on the type of sheets, such as thick paper, water-resistant paper, or color printing paper. Further, the amount of processing time required for folding can be shortened, and the performance of the sheet post-processing apparatus can be improved.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A sheet post-processing apparatus comprising;

stitching means for stitching with staples a sheet bundle conveyed along a conveyance path, the stitching means stitching the sheet bundle at plural places thereof along a straight line orthogonal to the conveyance direction;

folding means including a pair of folding rollers disposed downstream of the stitching means on the conveyance path and a blade that pushes the sheet bundle into a contact portion of the pair of folding rollers;

a folding roller drive motor that drives the pair of folding rollers; and control means for controlling the driving or stopping operation of the folding roller drive motor in correspondence to the process of folding the sheet bundle, the control means uses a voltage-type inverter comprising plural switching elements to generate a pulse width modulation control signal, and the control means pulse width modification drives the folding roller drive motor to vary its speed wherein the control means varies the speed of the folding roller drive motor during a period before the blade comes in contact with the sheet bundle, a speed of the folding roller drive motor during a period when the sheet bundle after folding work is being transported to a discharge port, a speed of the folding roller drive motor during a period when the sheet bundle is being discharged, and a speed of the folding roller drive motor during a period when the folding roller drive motor is being returned to a home position, and wherein the pulse width modulation control signal corresponding to a torque command is ON to switch ON the switching elements to apply the drive current in a direction, and the control means pulse width modification applies the drive current in an opposite direction when the pulse width modification control signal is OFF to switch OFF the switching elements.

2. The sheet post-processing apparatus according to claim 1, wherein during the period until the blade contacts the sheet bundle, the folding roller drive motor is driven at a speed suited for predetermined folding precision, during the period when the sheet bundle after folding is conveyed to a discharge port, the folding roller drive motor is driven at a speed that is higher than the speed suited for predetermined folding precision, during discharge operation of the sheet bundle, the folding roller drive motor is driven by a speed suited for maintaining paper discharge consistency, and during return of the folding roller drive motor to its home position, the folding roller drive motor is driven at a speed that is higher than the speed suited for predetermined folding precision.

3. The sheet post-processing apparatus according to claim 2, wherein the the drive speed during the period until the blade contacts the sheet bundle is 60% of the drive speed during the period when the sheet bundle after folding is conveyed to a discharge port, and the drive speed during the discharge operation of the sheet bundle is 80% of the drive speed during return of the folding roller drive motor to its home position.

4. The sheet post-processing apparatus according to claim 1 or 2, wherein the control means pulse width modification drives the folding roller drive motor to vary its speed.

5. The sheet post-processing apparatus according to claim 1 or 2, wherein each of the drive speeds is varied in accordance with sheet size.

6. The sheet post-processing apparatus according to claim 1 or 2, wherein each of the drive speeds is varied in accordance with sheet thickness.

7. The sheet post-processing apparatus according to claim 1 or 2, wherein each of the drive speeds is varied in accordance with the number of sheets to be folded.

* * * * *